US011447957B2

(12) United States Patent
Kulp, III

(10) Patent No.: US 11,447,957 B2
(45) Date of Patent: Sep. 20, 2022

(54) THREE-DIMENSIONAL FOAM SURFACE COVERING SYSTEM

(71) Applicant: Francis Bruce Kulp, III, Arlington, TX (US)

(72) Inventor: Francis Bruce Kulp, III, Arlington, TX (US)

( * ) Notice: Subject to any disclaimer, the term of this patent is extended or adjusted under 35 U.S.C. 154(b) by 127 days.

(21) Appl. No.: 16/776,442

(22) Filed: Jan. 29, 2020

(65) Prior Publication Data

US 2020/0256060 A1 Aug. 13, 2020

Related U.S. Application Data

(60) Provisional application No. 62/803,589, filed on Feb. 11, 2019.

(51) Int. Cl.

| | |
|---|---|
| ***E04F 13/072*** | (2006.01) |
| ***E04F 13/08*** | (2006.01) |
| ***B01B 1/00*** | (2006.01) |
| ***H04R 3/00*** | (2006.01) |
| ***H04R 1/02*** | (2006.01) |

(52) U.S. Cl.

CPC ..... *E04F 13/072* (2013.01); *B01B 1/00* (2013.01); *E04F 13/0871* (2013.01); *H04R 1/028* (2013.01); *H04R 3/00* (2013.01)

(58) Field of Classification Search

CPC ..... E04F 13/072; E04F 13/074; E04F 13/075; E04F 13/0871; H04R 1/028; H04R 3/00

See application file for complete search history.

(56) References Cited

U.S. PATENT DOCUMENTS

| | | | | |
|---|---|---|---|---|
| 7,380,385 | B2 * | 6/2008 | Yoon | E04F 13/0871 52/784.1 |
| 7,703,251 | B2 * | 4/2010 | Roh | B32B 15/08 52/309.9 |
| 7,784,229 | B2 * | 8/2010 | Ismay | G09F 7/08 52/222 |
| 8,191,326 | B2 * | 6/2012 | Shapiro | B44C 5/0461 52/506.05 |
| 8,220,215 | B2 * | 7/2012 | Ismay | E04F 13/0807 52/311.2 |
| 10,175,550 | B2 * | 1/2019 | Paolini, Jr. | G02F 1/1335 |
| 2015/0191914 | A1 * | 7/2015 | Biterman | E04B 2/721 52/220.7 |
| 2016/0259225 | A1 * | 9/2016 | Paolini, Jr. | G02F 1/1335 |
| 2017/0234018 | A1 * | 8/2017 | Bovijn | A47G 27/0437 52/506.05 |

FOREIGN PATENT DOCUMENTS

| | | | | |
|---|---|---|---|---|
| CA | 2851108 | A1 * | 10/2015 | E04F 13/072 |
| EP | 2679743 | A1 * | 1/2014 | H05B 47/105 |
| GB | 2376287 | A * | 12/2002 | G02B 6/0095 |

* cited by examiner

*Primary Examiner* — Babajide A Demuren

(74) *Attorney, Agent, or Firm* — Leavitt Eldredge Law Firm

(57) ABSTRACT

A three-dimensional surface covering system includes a surface mounting system configured to bond to a mounting surface, the surface mounting system having a panel to secure to the mounting surface; an attachment system; and an aesthetical covering removably secured to the panel via the attachment system; the aesthetical covering can be removed and changed as desired.

12 Claims, 6 Drawing Sheets

THREE-DIMENSIONAL FOAM SURFACE COVERING SYSTEM

BACKGROUND

1. Field of the Invention

The present invention relates generally to systems for aesthetically changing a surface, such as a wall, ceiling, or door, and more specifically, to a three-dimensional aesthetic surface coving for walls, ceilings, and doors that provides for changeable aesthetics.

2. Description of Related Art

Aesthetical improvement systems are well known in the art and are effective means to change the appearance of a surface. For example, FIG. 1 depicts a flowchart 101 of a conventional method of creating an aesthetical improvement. As shown, it is common for a user to desire a change, such as to a wall, door, ceiling, or other surface, as shown with box 103. This change may be minimal or may include elaborate and extensive changes. The user may create a new texture, such as on a wall, through conventional means, such as spray on textures or the like, as shown with box 105. Further, the user may mount or otherwise add more functional elements, such as lights, audio, and the like, as shown with box 107. These changes are conventionally permanent, or at least semi-permanent, as shown with box 109.

One of the problems commonly associated with conventional aesthetical improvement systems is limited flexibility. For example, the user may only want temporary aesthetical changes, or functional changes. Alternatively, should the user no longer be in control of a surface, such as when the user moves, a new individual or company may want to easily change the desired aesthetics of a surface.

Accordingly, although great strides have been made in the area of aesthetical improvement systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
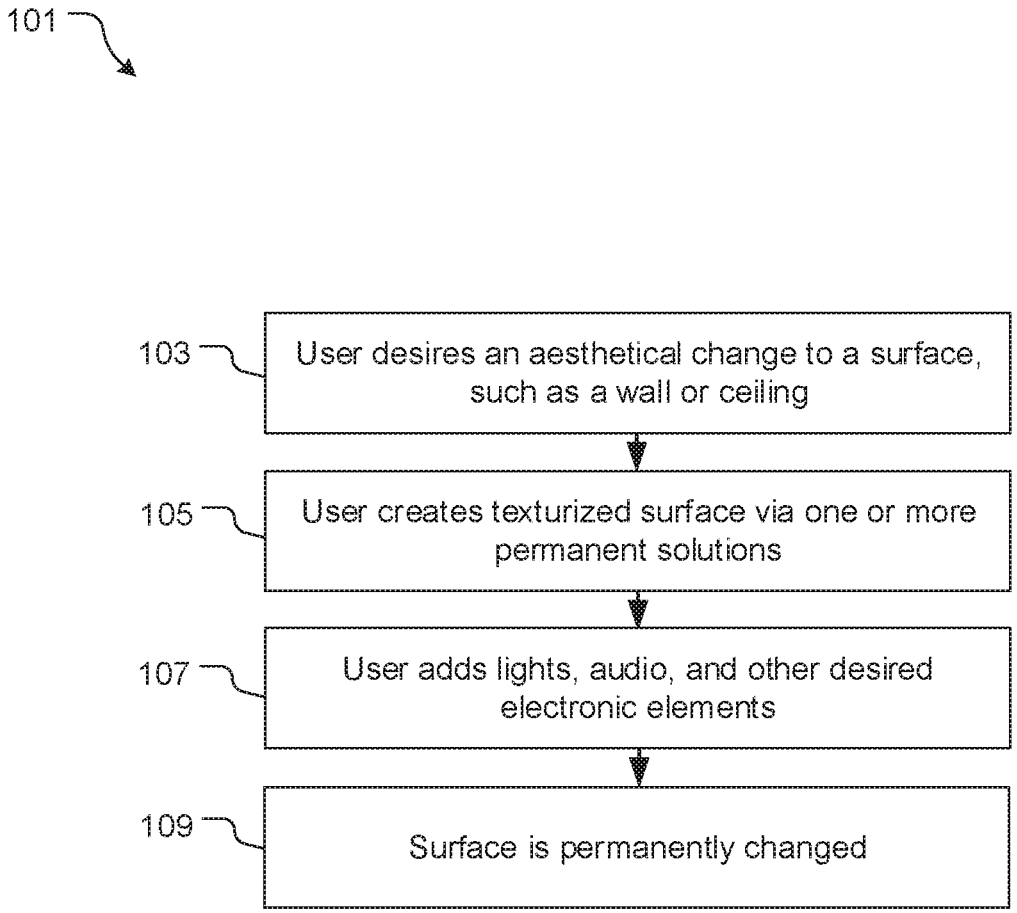
FIG. 1 (Prior Art)
FIG. 1 is a flowchart of a conventional aesthetical improvement system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional systems for aesthetically improving a surface. Specifically, the present invention provides for a system that allows for interchangeable panels without the necessity for complete removal of the system. The system allows for a wide range of customized aesthetic surfaces that are easily changeable without removing the underlying surface mounting system. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
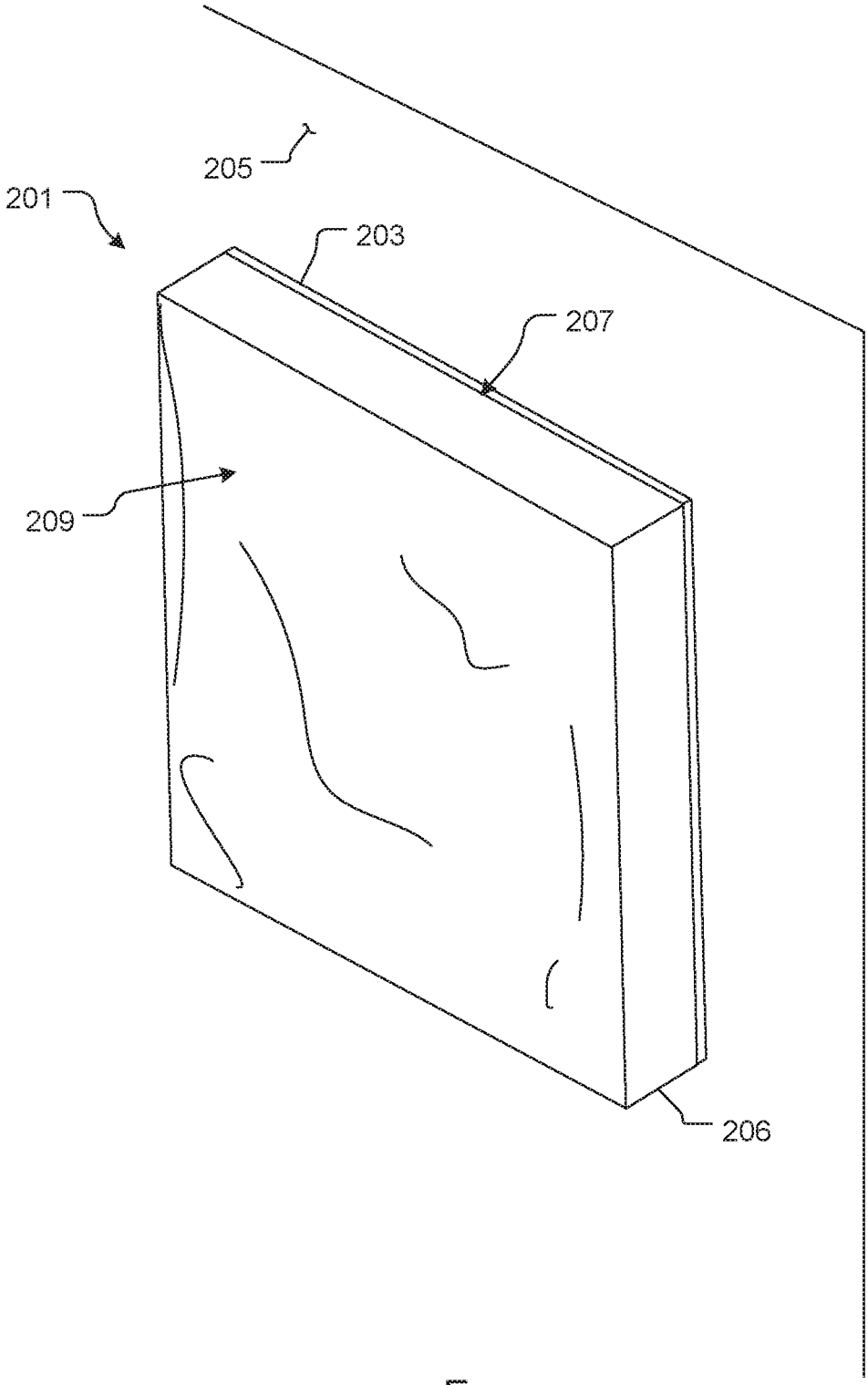
FIG. 2 is an isometric view of a three-dimensional foam surface covering system in accordance with the present application.

Referring now to the drawings wherein like reference characters identify corresponding or similar elements throughout the several views, FIG. 2 depicts an assembled view of a three-dimensional foam surface covering system 201 in accordance with the present invention. It will be appreciated that system 201 overcomes one or more of the above-listed problems commonly associated with conventional aesthetical improvement systems.

The system of the present invention consists essentially of two parts, (1) a transparent or semitransparent and semi-flexible panel that is fixed to a surface via a mounting system, and on the opposite side contains an attachment system that is compatible with (2) an aesthetic covering that is comprised of a three-dimensional flexible or semi-rigid foam panel with a molded, formed, or mechanically created aesthetic surface on one side that may or may not be treated with additional surface, texture, or color treatments. The two components interface, such that the two components are bonded together but removable.

In the contemplated embodiment, system 201 includes a panel 203 to secure to the mounting surface 205. As previously discussed, the mounting surface may be a wall, door, ceiling, or the like. The mounting surface may further be indoors or outdoors. It should be appreciated and understood that the panel 203 can vary in materials, shape, and size. In one preferred embodiment, the panel is transparent or semi-transparent and semi-flexible.

System 201 further includes an aesthetical covering 206 removably secured to the panel via the attachment system 207. It should be appreciated that the attachment system 207 can vary. For example, the attachment system may be an interfacing between the panel and the aesthetical covering. Further, the aesthetical covering and panel may be bonded together in some embodiments.

It should be appreciated that the aesthetical covering can vary. For example, in some embodiments, the covering 206 may include a textured front surface 209, further the front surface may be in various colors, including various patterns, or the like. In addition, the size and material of covering 206 may vary, however, in one embodiment the cover 206 is three-dimensional and composed of a foam.

It should be appreciated that one of the unique features believed characteristic of the present application is the combination of using a panel 203 as a mounting system to removably secure to an aesthetical covering 206. This allows for a user to change out the aesthetical covering 206 as needed and desired.

Figure 3:
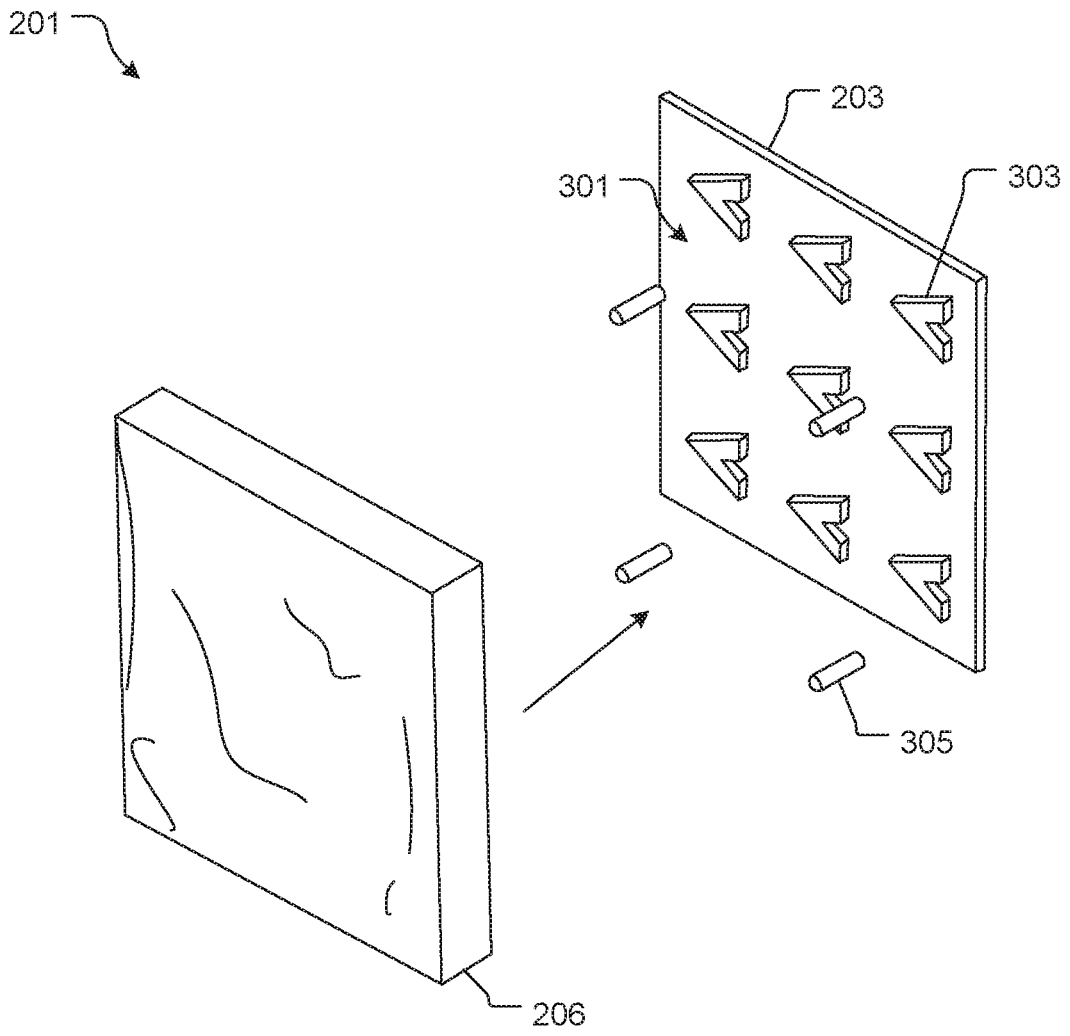
FIG. 3 is an isometric disassembled view of one embodiment of the system of FIG. 2.

In FIG. 3, an expanded view of one embodiment of a three-dimensional surface covering system 201 is shown, having panel 203 configured to engage and interface with aesthetical covering 207. As shown, the panel 203 will including a mounting system 301 which will provide for mounting of the panel 203 to the mounting surface, such as a wall. The mounting system 301 may vary, however, in this particular embodiment, the mounting system include a plurality of repeating mounts 303. The repeating mounts 303 may be bonding elements configured to bond the panel to the surface.

Further shown in FIG. 3, in some embodiments, a plurality of fasteners 305 that may be used with system 201. FIG. 3 depicts the disengagement of aesthetical covering 206, which can be removed for replacement as desired by the user. The system may be created such that the panel is designed to allow the installer of the system to easily detect mounting points for fasteners to a wall or surface as well as areas to relieve for clearance from obstructions to the panel during the mounting process.

It should further be appreciated that the backing panel is capable of being cut or configured without compromising the structural integrity of the panel or the attachment system properties according to one aspect of the present application.

Figure 4:
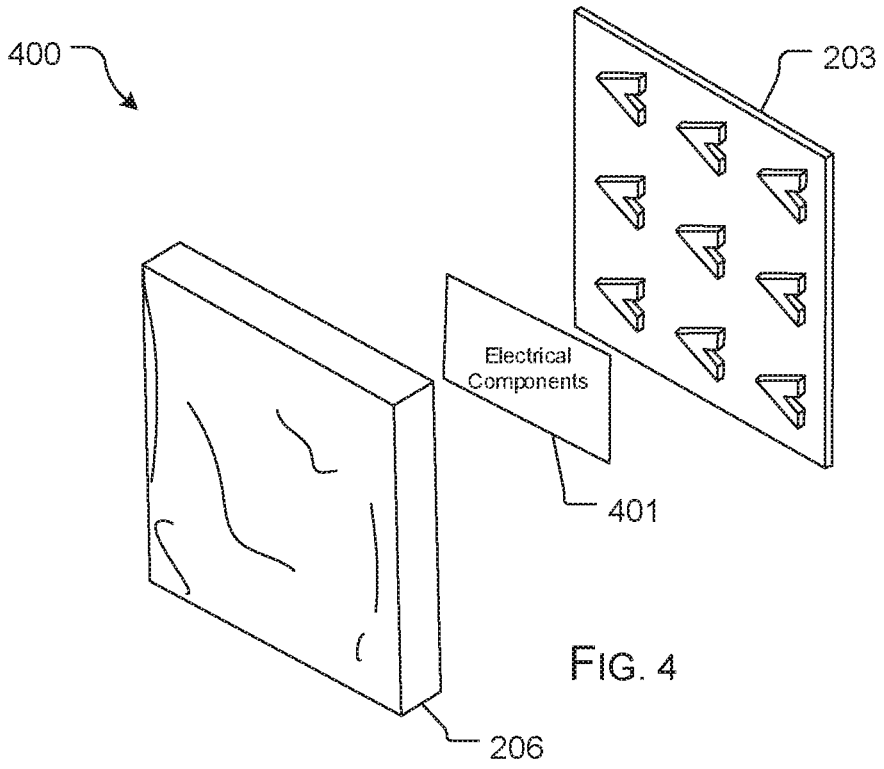
FIG. 4 is an isometric disassembled view depicting an embodiment of FIG. 2 having one or more electrical components.

In FIG. 4, an expanded view further depicts an embodiment of a three-dimensional surface covering system 400, having the components discussed above, and further having one or more electrical components 401 embedded between the aesthetical covering 206 and the panel 203. It should be appreciated that the exact method of attachment and components can vary. The one or more electrical components 401 providing either a functional or aesthetical benefit as desired by the user.

Figure 5:
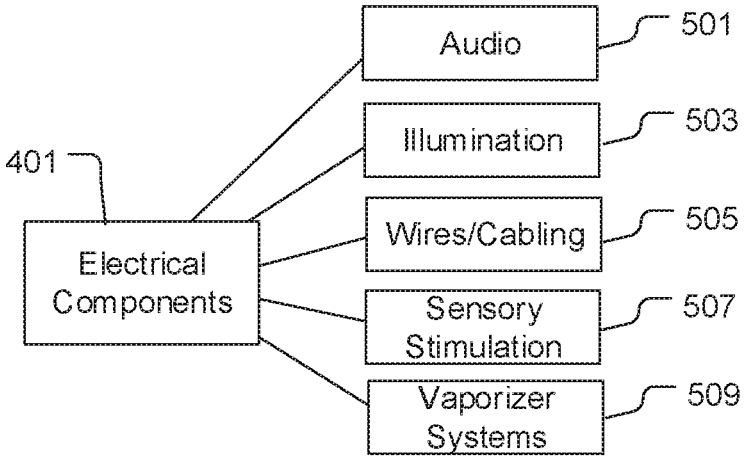
FIG. 5 is a schematic of a plurality of contemplated electrical components in accordance with the present application.

In FIG. 5 a schematic depicts some of the contemplated electrical components 401, including: one or more audio components 501 that may provide audio through the aesthetical covering; one or more illumination components 503, such as lights that may provide a functional or aesthetical benefit for the user; one or more wires and cables 505, which may be to provide electrical functionality to various electrical systems either contained within the aesthetical covering or elsewhere; one or more sensory stimulation elements 507; and one or more vaporizing systems 509, that may be configured to vaporize water based substances.

Figure 6:
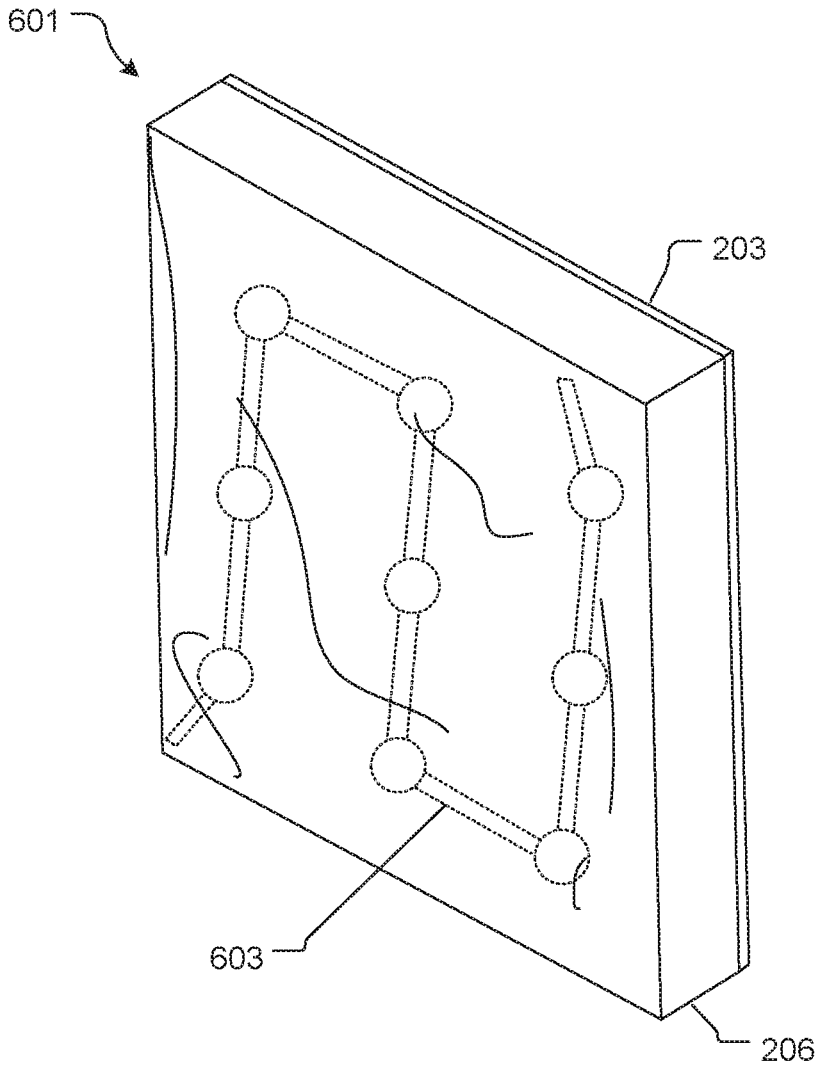
FIG. 6 is an isometric view of one example of an electrical component embedded within the system of FIG. 2 in accordance with the present application.

In FIG. 6, an isometric view of an exemplary embodiment of a system 601 having an electrical component 603 embedded between the panel 203 and aesthetical covering 206 is shown for clarity. As shown, the component 603 will be concealed, thereby providing functional benefits but without hindering the appearance of the system.

Figure 7:
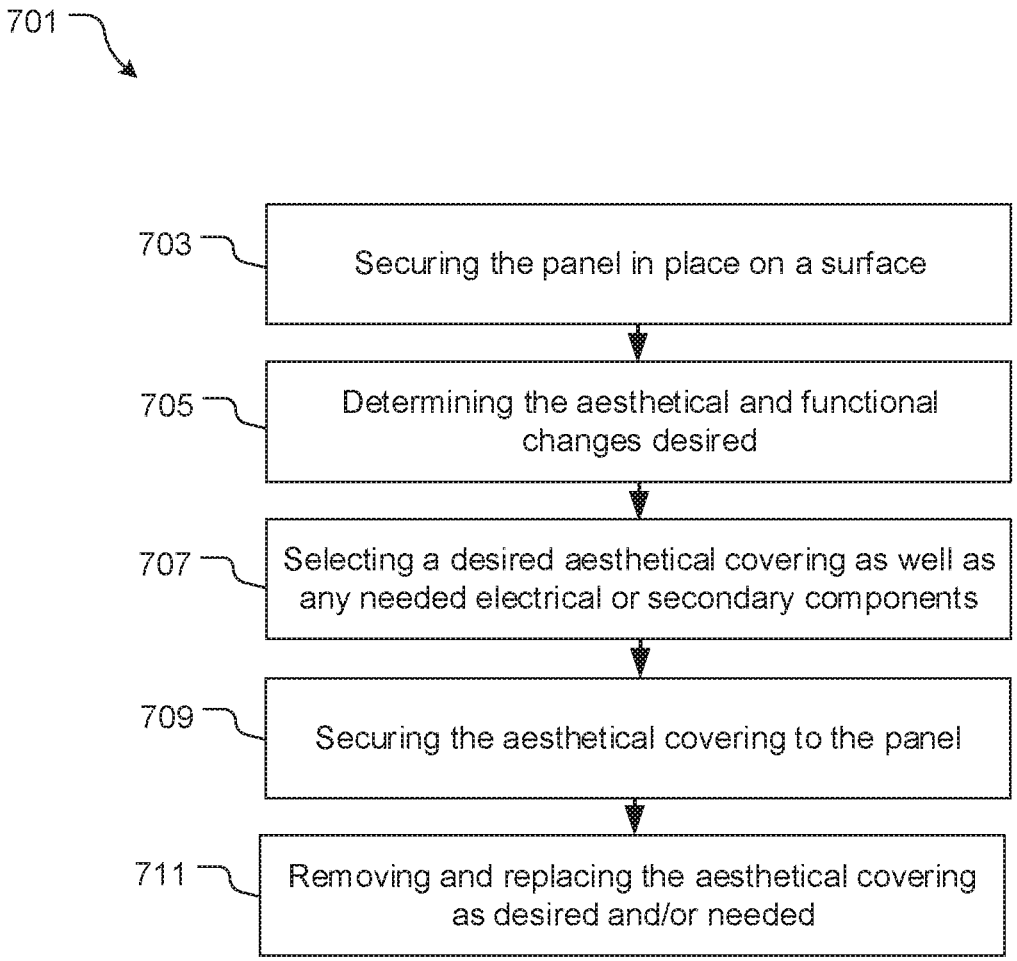
FIG. 7 is a flowchart of a method of use of the system of FIG. 2.

In FIG. 7, a flowchart 701 depicts the method of use of system 201. During use, the user will secure one or more of the panels associated with the mounting system to a surface, as shown with box 703. The user will then proceed to determine the aesthetical and/or functional changes desired, such as changing the texture of the surface, adding electrical components, and the like, as shown with box 705. The user will then select the needed aesthetical covering and secure the aesthetical covering to the panel, as shown with boxes 707, 709. The user can then remove and replace the aesthetical covering as needed and/or desired, as shown with box 711.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A three-dimensional surface covering system, comprising:

a surface mounting system configured to bond to a mounting surface, the surface mounting system having a panel to secure to the mounting surface;

an attachment system;

an aesthetical covering removably secured to the panel via the attachment system; and a vaporizing system secured to the attachment system, the vaporizing system is configured to eject water based substances;

wherein the aesthetical covering can be removed and changed as desired.

2. The system of claim 1, wherein the mounting system further comprises a plurality of bonding elements configured to bond the panel to the mounting surface.

3. The system of claim 1, wherein the aesthetical covering comprises:

a three-dimensional foam panel having a front aesthetical surface.

4. The system of claim 1, further comprising:

an electronic system embedded within the aesthetical covering.

5. The system of claim 4, wherein the electronic system comprises one or more illumination components.

6. The system of claim 4, wherein the electronic system comprises one or more audio components.

7. The system of claim 4, wherein the electronic system comprises one or more vaporizing devices.

8. The system of claim 1, wherein the attachment system extends from a back surface of the aesthetical covering.

9. The system of claim 1, wherein the surface mounting system further comprises a repeating mounting device to secure the panel to the mounting surface.

10. A method of changing an appearance of a surface, the method comprising:

providing the system of claim 1;

creating an aesthetical cover having a front surface; and securing the aesthetical cover to the panel via an attachment system;

wherein the front surface provides for the appearance desired.

11. The method of claim 10, further comprising:

incorporating one or more electrical components into the aesthetical cover.

12. The method of claim 10, further comprising:

removing the aesthetical cover from the panel.

* * * * *